US006962124B1

(12) United States Patent
North et al.

(10) Patent No.: US 6,962,124 B1
(45) Date of Patent: Nov. 8, 2005

(54) ROUND BOAT

(76) Inventors: Charles Dean North, 32558 E. 241 St. South, Porter, OK (US) 74454; Mark Douglas Childress, 32558 E. 241 St. South, Porter, OK (US) 74454; Rodney Irwin Howard, 32558 E. 241 St. South, Porter, OK (US) 74454

( * ) Notice: Subject to any disclaimer, the term of this patent is extended or adjusted under 35 U.S.C. 154(b) by 0 days.

(21) Appl. No.: 10/780,388

(22) Filed: Feb. 17, 2004

(51) Int. Cl.[7] ..... B63B 3/00
(52) U.S. Cl. ..... 114/346
(58) Field of Search ..... 114/346, 355, 56.1

(56) References Cited

U.S. PATENT DOCUMENTS 3,279,417 A * 10/1966 Moore et al. ..... 114/55.56
3,324,488 A * 6/1967 Schulz, Jr. ..... 114/346
3,335,436 A * 8/1967 Sharp ..... 114/346
3,718,111 A * 2/1973 Del Vecchio ..... 114/55.5
4,021,873 A * 5/1977 Francois ..... 114/345
4,240,171 A * 12/1980 Parsons ..... 441/56
4,367,689 A * 1/1983 Lukehart et al. ..... 114/346
4,856,452 A * 8/1989 Pingel et al. ..... 114/364
5,331,914 A * 7/1994 Salmons ..... 114/346
5,606,930 A * 3/1997 LeBlanc et al. ..... 114/144 R
5,863,228 A * 1/1999 Tether ..... 440/6
6,450,737 B1 * 9/2002 Rytand et al. ..... 405/219
6,543,378 B1 * 4/2003 Johnson, Sr. ..... 114/346

* cited by examiner

*Primary Examiner*—Andrew D. Wright
(74) *Attorney, Agent, or Firm*—LaRiviere, Grubman & Payne, LLP

(57) ABSTRACT

The present invention provides for a boat having a circular hull. The circular hull has a topside, a forward portion and an aft portion. Further, the circular hull has a first slot located in the forward portion and a second slot located in the aft portion. A rudder is connected to the circular hull within the aft portion. A motor having a motor shaft is connected to the circular hull within the slot located in its forward portion. The boat also can have one or more interior compartments to house batteries and other storage. A pedestal seat is secured to the topside of the circular hull.

17 Claims, 4 Drawing Sheets

ROUND BOAT

REFERENCE TO PENDING APPLICATIONS

This application is not based upon any pending domestic or international patent applications.

REFERENCE TO MICROFICHE APPENDIX

This application is not referenced in any microfiche appendix.

BACKGROUND OF THE INVENTION

1. Field of the Invention

The present invention is generally directed toward a boat, more specifically the present invention is directed toward a round boat, preferably a one person round boat.

2. Background

Circular watercrafts are known in the prior art. They include U.S. Pat. No. 6,543,378 issued to Johnson, Sr. and U.S. Pat. No. 4,021,873 issued to Francois. The prior art watercraft have various disadvantages. One disadvantage is that some watercrafts are unstable which require the use of complicated rudder assemblies or intricate floatation structures. For example, U.S. Pat. No. 5,331,914 issued to Salmons discloses a one person round boat that utilizes internal ballast chambers in an effort to provide stability to the watercraft.

Other watercrafts utilize inflatable pontoons to provide floatation. These watercrafts, however, introduce an aspect of unreliability due to the inherent risk of untimely deflation by the pontoons.

While the prior art discloses a various embodiments of a one person round boat such boats are not without there disadvantages. Accordingly, there is a need for an improved one person round boat.

BRIEF SUMMARY OF THE INVENTION

The present invention satisfies the needs discussed above. The present invention is generally directed toward a round boat, more particularly toward a highly stable round boat.

One aspect of the present invention provides for a boat having a circular hull. The circular hull has a topside, a forward portion and an aft portion. Additionally, the circular hull has a first slot located in the forward portion and a second slot located in the aft portion. A rudder is connected to the circular hull within the aft portion of said circular hull. A motor having a motor shaft is connected to the circular hull within the slot located at in the forward portion.

Another aspect of the present invention provides for the boat described above further having one or more internal compartments. The compartments can have a door to allow access therein. The compartments are designed to house storage and batteries which assist in the operation of the boat.

Another aspect of the present invention provides for a boat described above further having a pedestal seat. The seat can be secured to the topside or to one of the doors covering one of the compartments.

Another aspect of the present invention provides for the boat described above where the rudder is pivotally connected to the circular hull. This allows the rudder to be raised during transportation. This reduces the risk of accidental damage to the rudder.

Another aspect of the present invention provides for the boat described above where the circular hull includes wiring channels therein. The channels house various wiring and wiring harnesses.

Another aspect of the present invention provides for the boat described above where the circular hull includes a shell and floatation material. The shell provides a protective covering over the entire surface of the floatation material. One acceptable floatation material is multicellular expanded synthetic resinous material. Such material is commonly sold under the trademark STYROFOAM®. The shell can be constructed from a material that forms a watertight and airtight seal around the floatation material. This seal prohibits rust and corrosion of the floatation material and provides protection against surface abrasion. One acceptable material is polyurethane.

The floatation material can be a single piece or multiple pieces of material. The storage compartments are cut out of the floatation material. This allows the integrity of the hull to be maintained.

Other aspects of the present invention include the boat described above having a pole light for safety, polished rails extending around the edge of the circular hull and connecting plates to secure two or more boats together.

Upon reading the above description, various alternative embodiments will become obvious to those skilled in the art. These embodiments are to be considered within the scope and spirit of the subject invention, which is only to be limited by the claims which follow and their equivalents.

DETAILED DESCRIPTION OF THE PREFERRED EMBODIMENTS

The attached drawing demonstrates an embodiment of the present invention. It is to be understood that the invention is not limited in its application to the details of the construction and arrangement of parts illustrated in the accompanying drawings. The invention is capable of other embodiments and of being practiced or carried out in a variety of ways. It is to be understood that the phraseology and terminology employed herein are for the purpose of description and not of limitation.

Figure 1:
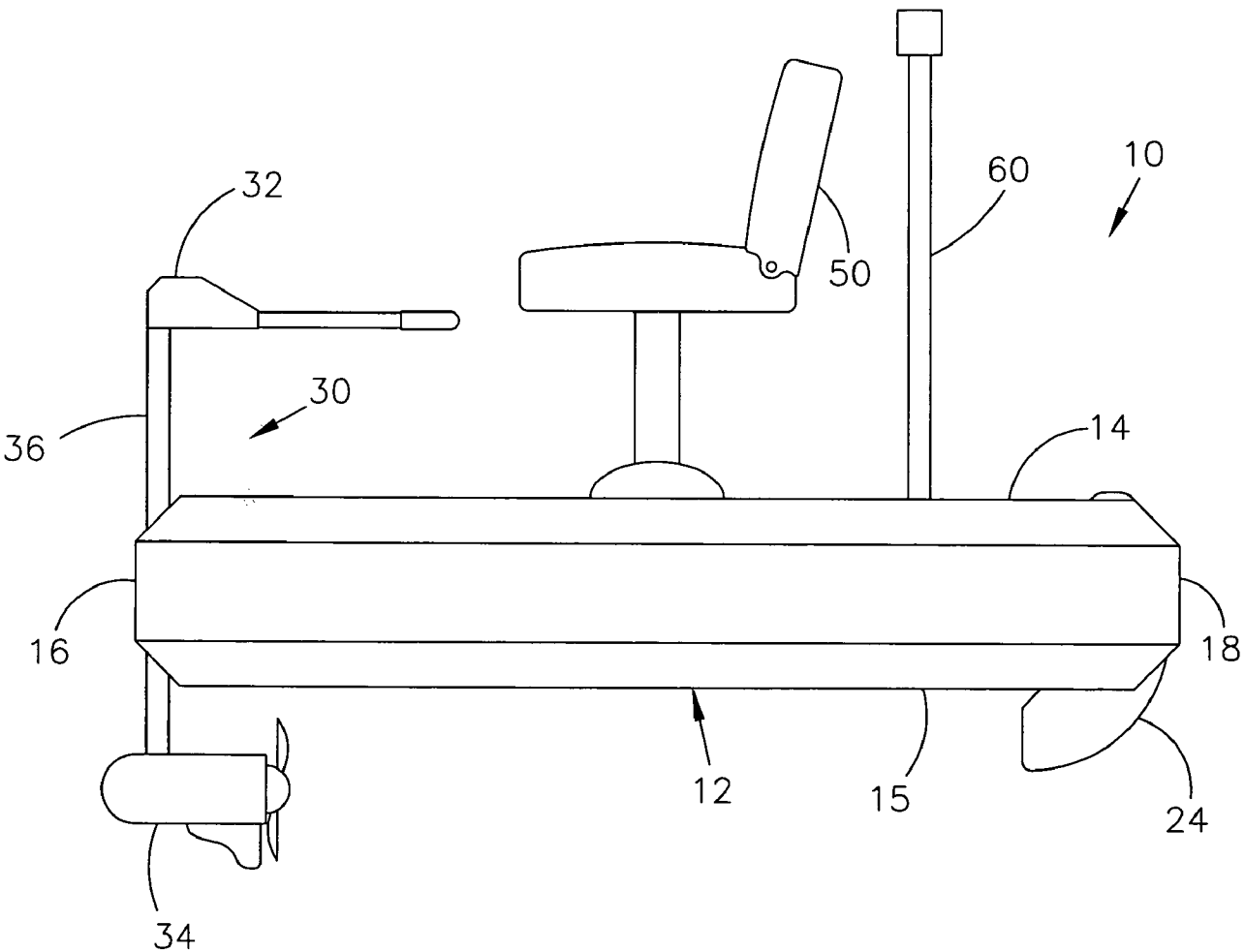
FIG. 1 is a prospective side view of an embodiment of the present invention.
Figure 2:
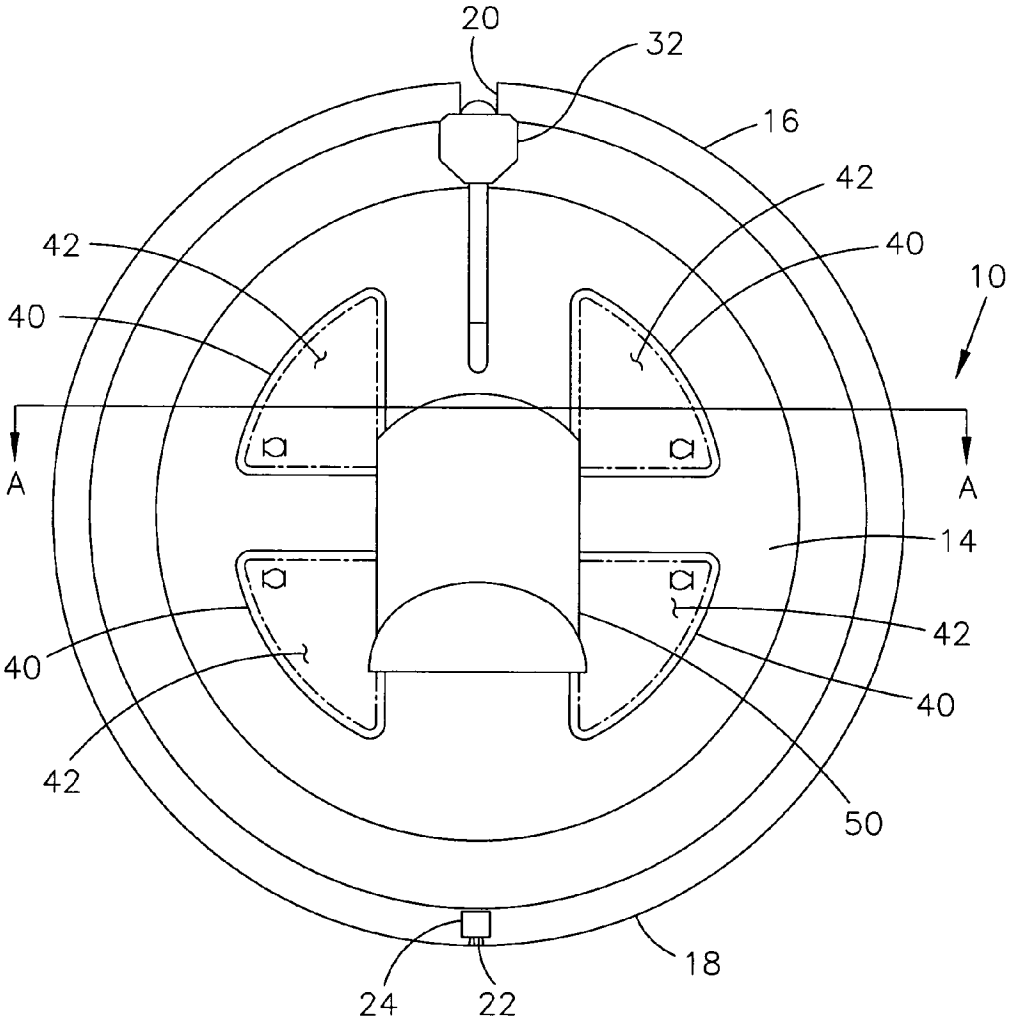
FIG. 2 is a prospective top view of the embodiment of the present invention set forth in FIG. 1.

As shown in FIG. 1, an embodiment 10 of the inventive boat is disclosed. Embodiment 10 comprises a circular hull 12 having a topside 14, a bottom side 15, a forward portion 16 and an aft portion 18. Additionally, the circular hull has a first slot 20 located in the forward portion 16 and a second slot 22 located in the aft portion 18, as shown in FIG. 2. A rudder 24 is connected to the circular hull 12 within the aft portion 18 of said circular hull 12. A motor 30 having control assembly 32, a prop assembly 34 and a shaft 36 there between is connected to the circular hull 12. To connect the motor 30 to the circular hull 12, the shaft 36 fits within the first slot 20 and is secured therein by standard securing means. Extending from topside 14 is a pole light 60.

As shown in FIG. 2, embodiment 10 also comprises a plurality of internal compartments 40. The compartments 40 can have a door 42 to allow access therein. The compartments 40 are designed to house storage and batteries which assist in the operation of embodiment 10. This embodiment is shown to have four compartments. It is understood this is for illustrative purposes and is not meant to be limiting. It is further understood that no compartments may be included in the inventive boat.

Figure 4:
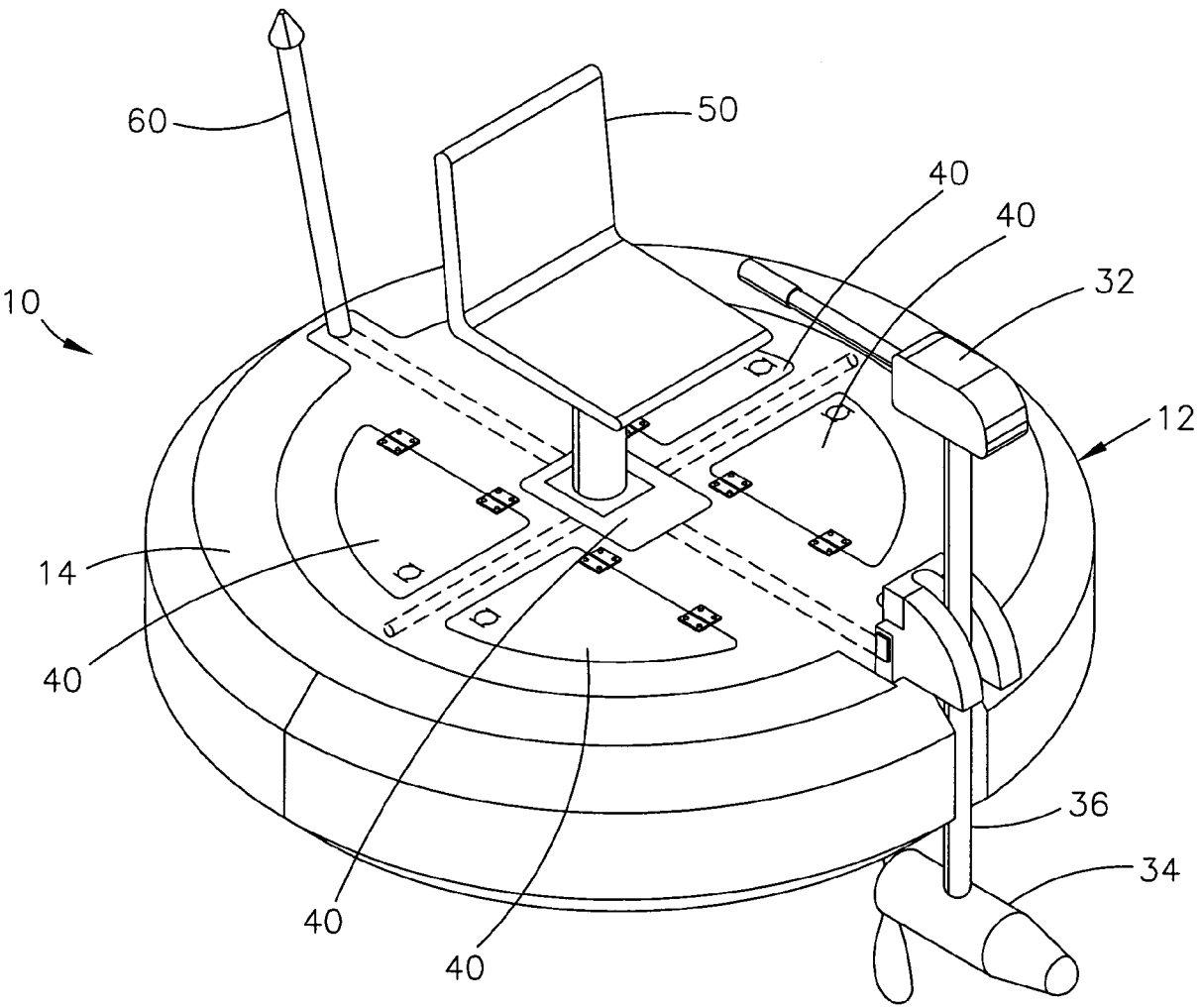
FIG. 4 is a perspective view of an additional embodiment of the present invention.

Embodiment 10 also comprises a seat 50. The seat 50 includes a pedestal 52 which can be secured to the topside 14 or to one of the doors 42 (See FIG. 4) covering one of the compartments 40. Further, seat 50 is designed to swivel so to allow the user with a maximum ability to see and obverse his surroundings.

Rudder 24 can be permantly or pivotally secured by a hinge mechanism (not shown) to the circular hull 12. When rudder 24 is secured with a hinge mechanism, it is capable of being raised from time to time, such as during transportation. This reduces the risk of accidental damage to the rudder 24.

Figure 3:
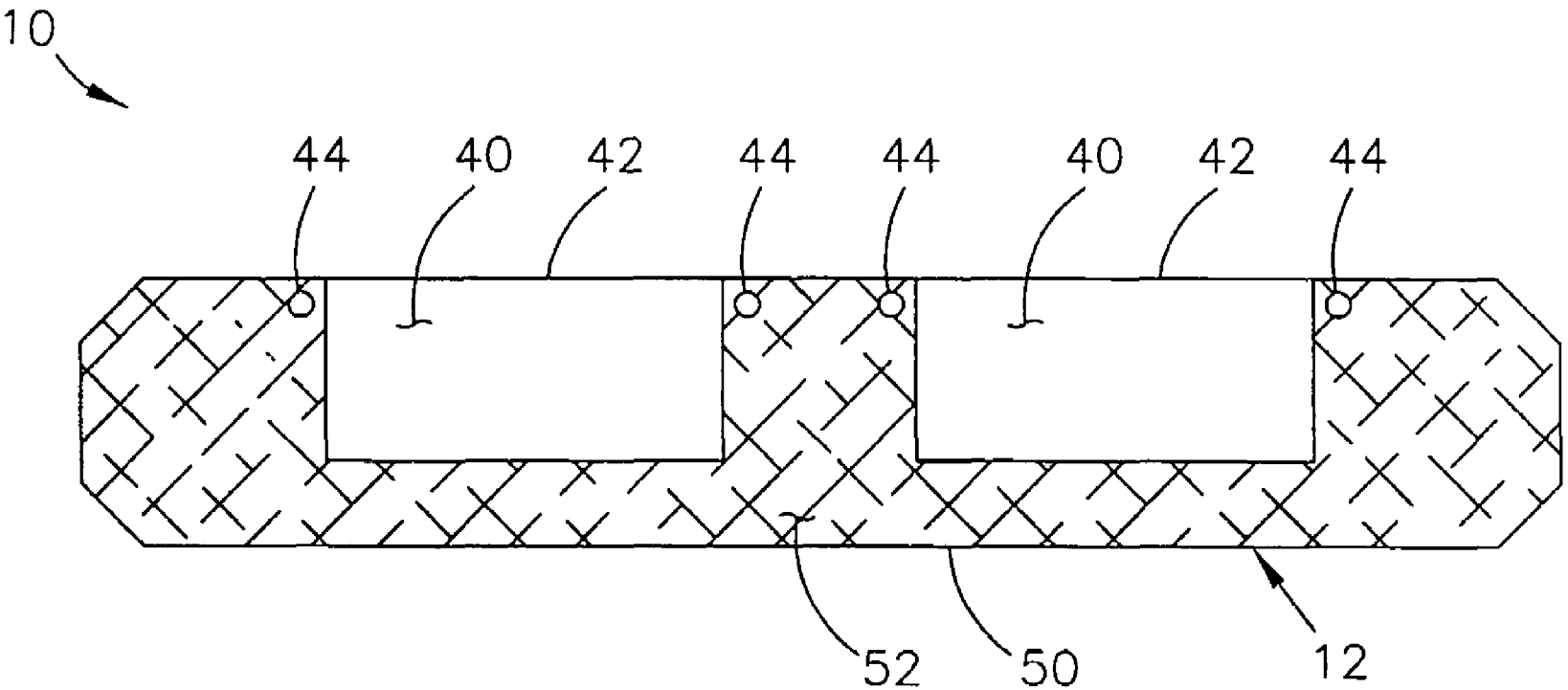
FIG. 3 is a cut-away view of the embodiment of the present invention set forth in FIG. 2.

As shown in FIG. 3, another aspect which could be included within embodiment 10 comprises the circular hull 12 includes wiring channels 44 therein. The channels 44 house various wiring and wiring harnesses.

Yet another aspect which could be included within embodiment 10 comprises circular hull 12 includes a shell 50 and floatation material 52. The shell 50 provides a protective covering over the entire surface of the floatation material 52. One acceptable floatation material is multicellular expanded synthetic resinous material. Such material is commonly sold under the trademark STYROFOAM®. The shell 50 can be constructed from a material that forms a watertight and airtight seal around the floatation material 52. This seal prohibits rust and corrosion of the floatation material 52 and provides protection against surface abrasion. One acceptable material is polyurethane.

The floatation material 52 can be a single piece or multiple pieces of material. The storage compartments 40 are cut out of the floatation material 52. This allows the integrity of the circular hull 12 to be maintained.

Other aspects of the present invention not shown include an embodiment having a a pole light for safety, polished rails extending around the edge of the circular hull 12 and connecting plates to secure two or more boats together.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification.

What is claimed is:

1. A boat comprising:

a circular hull having a topside, a forward portion and an aft portion, said circular hull having a first slot located along the peripheral edge of said forward portion of said circular hull and a second slot located along the peripheral edge of said aft portion of said circular hull;

a rudder connected to said circular hull within said second slot of said circular hull;

a motor having a motor shaft connected to said circular hull within said first slot of said circular hull; and a seat having a seat pedestal, said seat pedestal being connected to said topside of said circular hull.

2. The boat of claim 1 wherein said circular hull having a one or more compartments located therein.

3. The boat of claim 2 wherein each of said one or more compartments have door to allow access therein.

4. The boat of claim 2 wherein said one or more compartments comprise at least one compartment to house a battery.

5. The boat of claim 4 wherein said one or more compartments further comprises one or more compartments to house a storage.

6. The boat of claim 3 wherein said seat pedestal is connected to one of said doors of said one or more compartments.

7. The boat of claim 1 wherein said rudder is pivotally connected said circular hull.

8. The boat of claim 7 further comprising a pole light.

9. The boat of claim 1 wherein said motor is an electric motor.

10. The boat of claim 1 wherein said motor is a radio controlled motor.

11. The boat of claim 1 wherein said motor is a remote controlled motor.

12. The boat of claim 1 wherein said circular hull comprises a shell and floatation material contained therein, said shell providing a protective covering over the entire surface of said floatation material.

13. The boat of claim 12 wherein said floatation material is constructed from solid masses of multicellular expanded synthetic resinous material.

14. The boat of claim 12 wherein said shell is constructed from a material that forms a watertight and airtight seal around said floatation material which prohibits rust, corrosion and surface abrasion.

15. The boat of claim 12 wherein said shell is constructed from polyurethane.

16. The boat of claim 12 wherein said circular hull having a one or more compartments being formed within said floatation material.

17. The boat of claim 16 wherein each of said one or more compartments have a door to allow access therein.

* * * * *